US007699507B2

(12) United States Patent
Bleiner et al.

(10) Patent No.: US 7,699,507 B2
(45) Date of Patent: Apr. 20, 2010

(54) DEVICE AND METHOD OF OPTICALLY SIGNALLING ROAD OR TRAFFIC LANES, SPECIFICALLY IN LOW VISIBILITY CONDITIONS

(75) Inventors: Thomas Bleiner, Montagnola (CH); Bruno Dussert-Vidalet, Longare (IT)

(73) Assignee: Astron Fiamm Safety S.p.A., Montecchio Maggiore (IT)

( * ) Notice: Subject to any disclaimer, the term of this patent is extended or adjusted under 35 U.S.C. 154(b) by 236 days.

(21) Appl. No.: 11/576,883

(22) PCT Filed: Oct. 5, 2005

(86) PCT No.: PCT/IB2005/002958

§ 371 (c)(1),
(2), (4) Date: Aug. 4, 2007

(87) PCT Pub. No.: WO2006/038093

PCT Pub. Date: Apr. 13, 2006

(65) Prior Publication Data

US 2008/0191901 A1 Aug. 14, 2008

(30) Foreign Application Priority Data

Oct. 7, 2004 (IT) ..... VI2004A0235

(51) Int. Cl.
*F21S 8/00* (2006.01)

(52) U.S. Cl. ..... 362/431; 362/153.1; 362/559

(58) Field of Classification Search ..... 362/153.1, 362/431, 591
See application file for complete search history.

(56) References Cited

U.S. PATENT DOCUMENTS 7,089,114 B1 8/2006 Huang

FOREIGN PATENT DOCUMENTS

| | | |
|---|---|---|
| DE | 655300 | 1/1938 |
| DE | 1212461 | 3/1966 |
| EP | 0710744 | 5/1996 |
| JP | 10003599 | 1/1998 |
| JP | 2000290943 | 10/2000 |
| JP | 2004232387 | 8/2004 |

*Primary Examiner*—Sandra L O'Shea
*Assistant Examiner*—Meghan K Dunwiddie
(74) *Attorney, Agent, or Firm*—Themis Law

(57) ABSTRACT

An optical signaling apparatus for use in highways or roadways (2), particularly in low visibility conditions, wherein a roadway (2) comprises at least one traffic bearing surface (S) with at least one edgeline (3). The apparatus comprises light-emitting means (4) for emitting at least one laser beam (5) and support means (6) designed to be arranged along the roadway (2) for supporting the light-emitting means (4). The apparatus also includes optical means (7) arranged along the roadway (2) for interacting with the beam (5) in such a manner as to selectively conform and project it either in a first direction ($D_1$) which is incident on at least one edgeline (3) to interact therewith, or in a second direction ($D_2$) substantially parallel to the traffic bearing surface (S) to define a substantially continuous optical path that can be viewed by the users, or even in both such directions ($D_1$, $D_2$).

16 Claims, 3 Drawing Sheets

DEVICE AND METHOD OF OPTICALLY SIGNALLING ROAD OR TRAFFIC LANES, SPECIFICALLY IN LOW VISIBILITY CONDITIONS

FIELD OF THE INVENTION

This invention finds application in the field of road safety systems and specifically relates to an optical signaling apparatus for use on a highway or roadway, particularly in low visibility conditions.

The invention further relates to a process for providing optical signaling of an edgeline in a roadway, particularly in low visibility conditions, which uses an optical signalling apparatus as described above.

STATE OF THE ART

For remote signalling of a roadway centerline, e.g. in curved highway sections or airport runways, applicable regulations require the installation of signs, normally known as road edge delineators, which are aimed at highlighting the centerline to guide the user even under low visibility conditions.

Reflector signs are typically used, which can be better seen when directly illuminated. One example of such solution is known from U.S. Pat. No. 5,950,992, which discloses a guardrail assembly having reflectors mounted thereon. Other examples of reflector devices are disclosed in U.S. Pat. No. 6,733,205 and US2003/030924.

These solutions have the drawback that they do not provide sufficient visibility under fog, rain and snow conditions. Also, especially at nighttime, someone driving in a car at high speeds might perceive an obstacle too late to avoid the crash.

In an attempt to obviate these drawbacks, various solutions have been proposed, in which the delineators are illuminated by light-emitting devices.

For instance, from application JP2003/098358, an apparatus is known which includes a guardrail assembly, using a light guide.

However, this apparatus only partly overcomes the above drawback. While the guardrail assembly is effective in good visibility conditions, it is much less visible under bad weather conditions, such as rain, snow, hail or fog.

Also, incandescent light is known to involve a high power consumption, which makes the use of these apparatuses expensive and poorly cost-effective.

A further progress in the solution of the above technical problems consists in the use of laser light which, as is known, becomes visible on persistent atmospheric suspension, such as on fog, rain and snow and is an optimal solution under bad weather conditions.

From EP-A-0390749, a road signaling apparatus is known, which uses an optical waveguide in an edgeline delineator, such as a guardrail. The illuminated end portions of the waveguide are predeterminedly spaced over the support structure, to provide a light guide for drivers.

Nevertheless, this apparatus also has drawbacks, especially the discontinuity of the light guide signal. In case of marked undulation of the roadway, the sign might be improperly interpreted. Furthermore, as disclosed in this document, the light beam emitted from the optical waveguide is not visible if the viewing angle exceeds 12°.

In the above apparatus, the beams emitted from the end portions of the optical waveguides are substantially perpendicular to the roadway, therefore the illuminated roadway section is the one closest to the driver, whereas the farthest section is dangerously invisible.

EP-A-0710744 discloses an optical signaling apparatus comprising light-emitting means for emitting a series of laser beams and including optical means for projecting the beams in a direction substantially parallel to the traffic bearing surface. From JP-A-410003599 an optical signalling apparatus is known having all the features on the preamble of claim 1 and specifically comprising a light-emitting column having optical means for projecting a laser beam incident with the edgeline. However, this known isolated apparatus does not provide a clear and visible signalling of the edgeline and is prone to be ignored by the driver in low visibility condition.

SUMMARY OF THE INVENTION

The object of this invention is to overcome the above drawbacks, by providing an optical signaling apparatus for use in highways or roadways, particularly in low visibility conditions that achieves high efficiency and has a relatively simple construction.

A particular object is to provide an apparatus as described hereinbefore that enhances edgeline markings on the roadway, in case of good visibility, and possibly at least partially replaces those markings in case of low visibility.

A further object is to provide an apparatus that increases visibility of the signs as weather conditions and thence environmental illumination conditions worsen.

Another object of the invention is to provide an apparatus that has a low power consumption and high endurance.

Yet another object is to provide an optical signaling process that ensures high efficiency and cost-effectiveness.

These objects, as well as other objects that will be more apparent hereafter, are fulfilled by an optical signalling apparatus for use in highways or roadways, particularly in low visibility conditions, wherein the incident beams projected in a first direction are so conformed that the laser light materialized in the air suspension has the form of a saw-tooth barrier to provide a sort of optically signaling wall.

Thanks to this particular arrangement, the apparatus of the invention allows to enhance the edgeline markings on the roadway in good visibility conditions and to at least partly replace it in low visibility conditions.

In a further aspect of the invention, a process for providing visual signaling of a road edge is taught, wherein incident beams are so projected in said first direction on an edgeline that the laser light materialized in the air suspension has the form of a saw-tooth barrier to provide a sort of optically signaling wall.

BRIEF DESCRIPTION OF THE DRAWINGS

Further features and advantages of the invention will be more apparent from the detailed description of a preferred, non-exclusive embodiment of an apparatus according to the invention, which is described as a non-limiting example with the help of the annexed drawings, in which.

DETAILED DESCRIPTION OF A PREFERRED EMBODIMENT

Figure 1:
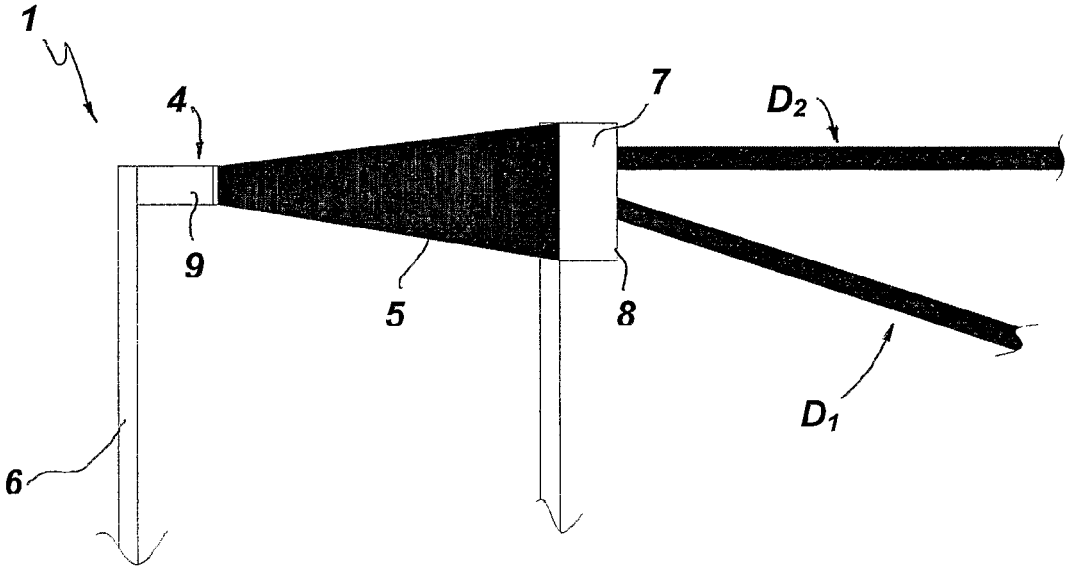
FIG. 1 is a diagrammatic view of the apparatus according to the invention.
Figure 2:
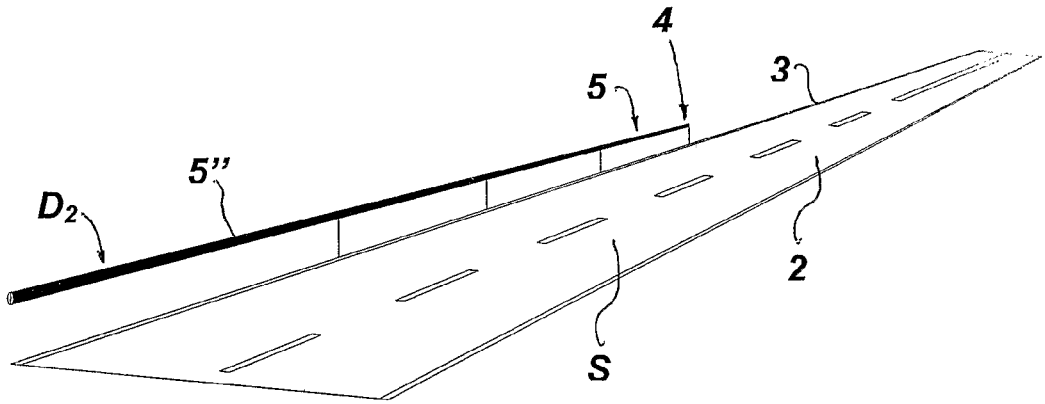
FIGS. 2, 3 and 4 are diagrammatic views of a configuration of the inventive apparatus.
Figure 3:
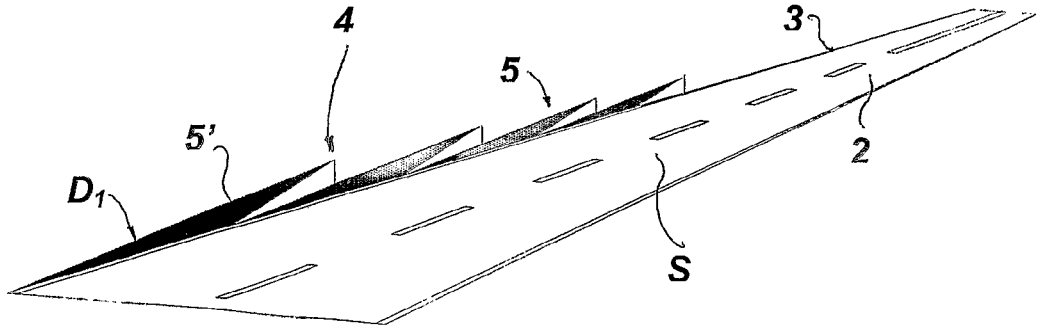
Figure 4:
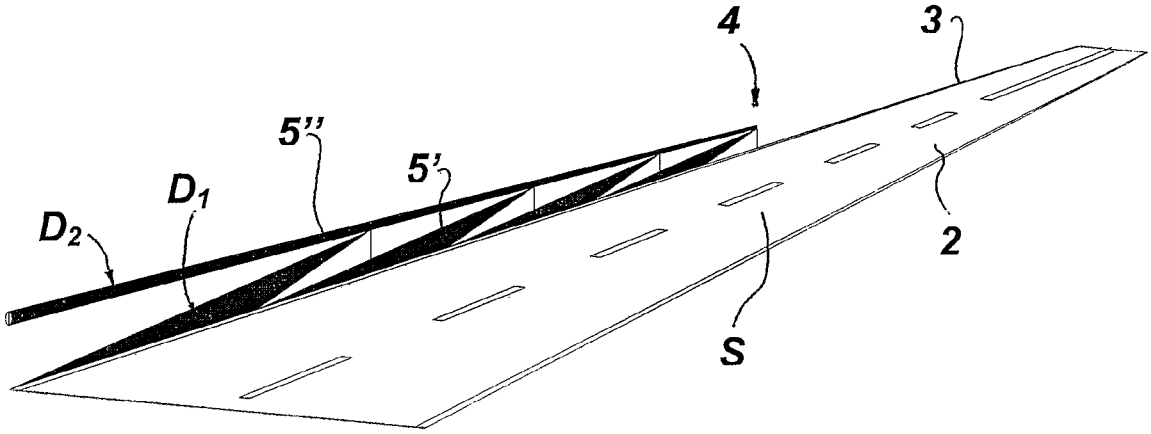
Figure 5:
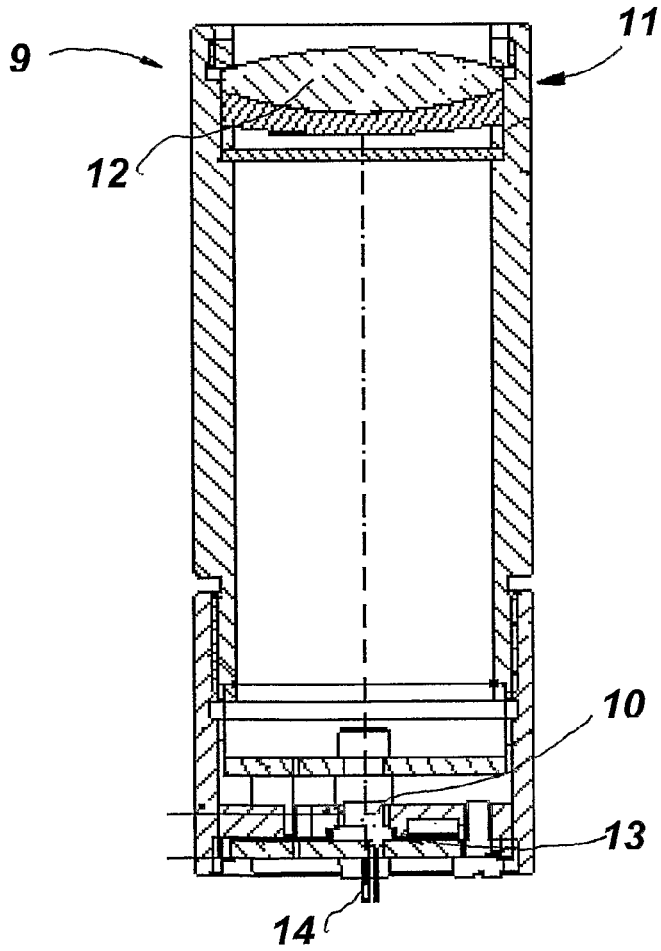
FIG. 5 is a sectional view of a detail of FIG. 1.
Figure 6:
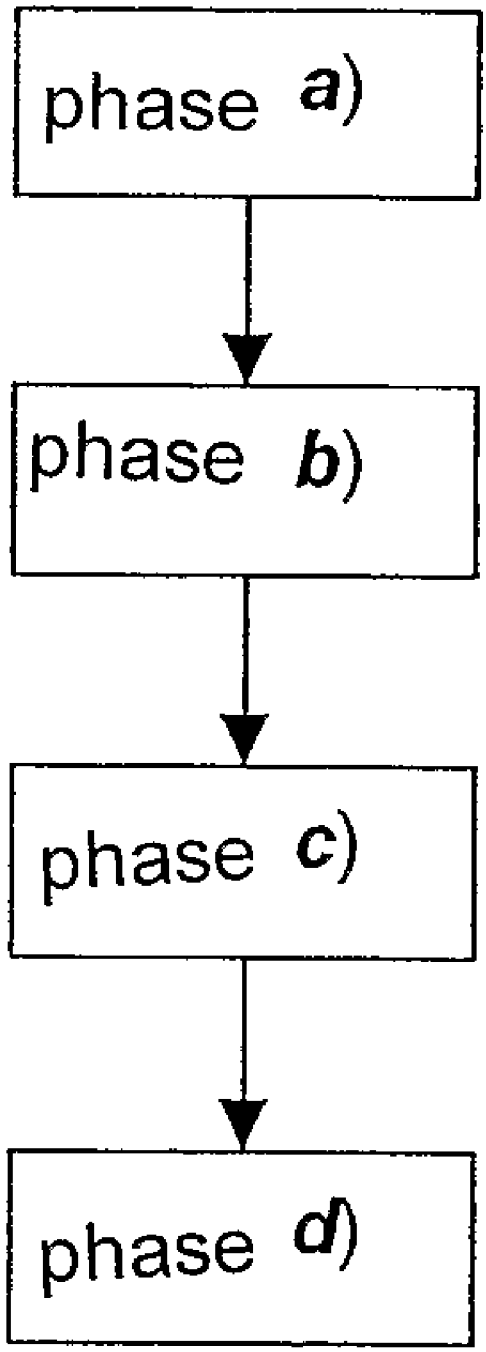
FIG. 6 shows a flowchart of the inventive process.

Referring to the above Figures, the inventive apparatus, generally designated by numeral 1, is designed to be used in a highway or roadway 2, such as a national road, a motorway or an airport runway, having at least one edgeline 3.

The apparatus 1 comprises light-emitting means 4 for emitting a laser beam 5 and support means 6, e.g. tripods, guardrails or support rods, designed to be arranged along the roadway 2 for supporting the light-emitting means 4.

In accordance with the invention, optical means 7, preferably prisms 8, are arranged along the roadway 2, for interacting with the beam 5 to conform and project it in a first direction $D_1$ incident on the edgeline 3.

Alternatively, the optical means 7 may project the beam 5 in a second direction $D_2$ substantially parallel to the traffic bearing surface S, or even in both of said directions $D_1$ and $D_2$.

Laser light is known to be visible on a persistent atmospheric suspension, such as an aerosol (fog), or a rain- or snowfall. Hence, the use of such type of light emission may allow the apparatus 1 to be particularly fit for rain, hail, snow or fog conditions.

According to the invention, the apparatus 1 may be configured in such a manner as to be able to project the beam 5 either in one direction $D_1$, or in one direction $D_2$, or even in both directions $D_1$ and $D_2$.

The first configuration allows to illuminate the continuous edgeline. Thus, in optimal visibility conditions, the latter is particularly apparent to a vehicle driver. In poor visibility conditions, i.e. in bad weather conditions, the laser light will materialize the suspension in air thereby forming a saw-tooth barrier 5, and providing a sort of optical signaling wall.

The second configuration provides continuous signaling, in unfavorable weather conditions, along the roadway edge 2, to assist a driver by forming a sort of handrail 5", to highlight the altitude profile of the road.

The third configuration combines the benefits of both the above configurations, by generating both a barrier 5' and a handrail 5", to provide optimized assistance to the driver under unfavorable visual conditions.

Advantageously, the light-emitting means 4, may include a projector 12 having a semiconductor light source 10, preferably of the visible light-emitting laser or LED type. The projector 9 may have light diffusing means 11, selected from the group consisting of lenses, prisms, mirrors, LCD electron mirrors, micromirrors, and preferably consisting of a diffractive lens 12.

Furthermore, the projector 9 might also have means 13 for controlling the beam 5, preferably a microprocessor unit. Advantageously, the microprocessor unit may be programmed to adjust the distance I between the light source 10 and the lens 12.

The projector 9 may also comprise power supply means 14. As is known, power consumption of a semiconductor source is substantially low, whereby the apparatus 1 as a whole is cost-effective and has a high endurance.

The means 14 may possibly include a battery or an accumulator, which will operate in power failure conditions.

A process for providing optical signaling of an edgeline in a roadway 2 as described hereinbefore includes the following steps.

In a first step a), light emitting means 4 are provided, as described above. This step is followed by a step b) in which optical means 7 are provided along the roadway 2.

Then, in a step c) the beam 5 is emitted, and in a next step d) the beam is selectively conformed and projected in the direction $D_1$, in the direction $D_2$, or in both.

From the above disclosure, the apparatus of the invention proves to fulfill the proposed objects and particularly enhances the edgeline markings on the roadway in perfect visibility conditions and at least partially replaces them in poor visibility conditions.

The optical means 7 allow to deflect the beam 5 in the directions $D_1$ and $D_2$, to provide highly visible signaling, with an increased effectiveness in unfavorable weather conditions.

The apparatus of this invention is susceptible to a number of changes and variants, within the inventive concept disclosed in the appended claims. All the details thereof may be replaced by other technically equivalent parts, and the materials may vary depending on different needs, without departure from the scope of the invention.

While the apparatus has been described with particular reference to the accompanying figures, the numerals referred to in the disclosure and claims are only used for the sake of a better intelligibility of the invention and shall not be intended to limit the claimed scope in any manner.

What is claimed is:

1. An optical signaling apparatus for use in, particularly in low visibility conditions, wherein a roadway comprises at least one traffic bearing surface with at least one edgeline, the apparatus comprising:

a plurality of light-emitting means for emitting respective laser beams;

support means designed to be arranged along the roadway for supporting said plurality of light-emitting means;

optical means designed to be arranged along the roadway and to interact with said beams generated by said plurality of light-emitting means, said optical means being provided in different units from said light emitting means;

wherein said optical means are designed to selectively conform and project said beams in a first direction incident on the at least one edgeline, and wherein the incident beams projected in said first direction are so conformed that laser light materialized in air suspension has a form of a saw-tooth barrier that operates as an optically signaling wall.

2. The apparatus as claimed in claim 1, wherein said optical means are so designed as to selectively conform and project said incident beams also in a second direction substantially parallel to the traffic bearing surface to define a substantially continuous optical path shaped as a handrail.

3. The apparatus as claimed in claim 1, wherein said optical means comprise at least one prism.

4. The apparatus as claimed in claim 1, wherein said at least one edgeline includes at least partly edge delimitation markings.

5. The apparatus as claimed in claim 1, wherein said light-emitting means comprise at least one projector with a semiconductor source.

6. The apparatus as claimed in claim 5, wherein said semiconductor source is of a visible light-emitting laser or LED type.

7. The apparatus as claimed in claim 5, wherein said projector has light diffusing means selected from the group consisting of lenses, prisms, mirrors, LCD electron mirrors, and micromirrors.

8. The apparatus as claimed in claim 7, wherein said lenses comprise a diffractive lens.

9. The apparatus as claimed in claim 5, characterized in that said projector comprises control means for controlling a respective laser beam.

10. The apparatus as claimed in claim 9, wherein said control means comprise at least one microprocessor unit.

11. The apparatus as claimed in claim 10, wherein said microprocessor unit is adapted to adjust a distance between said semiconductor source and said projector.

12. The apparatus as claimed in claim 5, wherein said projector comprises power supply means.

13. The apparatus as claimed in claim 12, wherein said power supply means comprise at least one battery or an accumulator.

14. The apparatus as claimed in claim 1, wherein said support means are selected from the group consisting of a tripod, a guardrail, and a support rod.

15. A process for providing optical signaling in a roadway, particularly in low visibility conditions, wherein said roadway comprises at least one traffic bearing surface with at least one edgeline (3), the process comprising:

providing a plurality of light-emitting means for emitting respective laser beams and support means arranged along said roadway for supporting said plurality of light-emitting means;

providing optical means along said roadway, said optical means being provided in different units from said light emitting means;

emitting said respective laser beams;

selectively conforming and projecting said respective laser beams in a first direction which is incident on said at least one edgeline to interact therewith, wherein said incident beams are so projected in said first direction on said at least one edgeline that laser light materialized in air suspension has a form of a saw-tooth barrier that operates as an optically signaling wall.

16. The process as claimed in claim 15, further comprising the step of selectively conforming and projecting said respective laser beams in a second direction substantially parallel to said traffic bearing surface in such a manner to define a substantially continuous optical path shaped as a handrail.

* * * * *